US009722303B2

(12) United States Patent
Hsieh et al.

(10) Patent No.: US 9,722,303 B2
(45) Date of Patent: Aug. 1, 2017

(54) WEARABLE ELECTRONIC DEVICE

(71) Applicants: Yi-Ting Hsieh, Taipei (TW); Saou-Wen Su, Taipei (TW); Chih-Chung Lin, Taipei (TW)

(72) Inventors: Yi-Ting Hsieh, Taipei (TW); Saou-Wen Su, Taipei (TW); Chih-Chung Lin, Taipei (TW)

(73) Assignee: ASUSTeK COMPUTER INC., Taipei (TW)

( * ) Notice: Subject to any disclaimer, the term of this patent is extended or adjusted under 35 U.S.C. 154(b) by 93 days.

(21) Appl. No.: 14/503,420

(22) Filed: Oct. 1, 2014

(65) Prior Publication Data

US 2015/0091764 A1 Apr. 2, 2015

Related U.S. Application Data

(60) Provisional application No. 61/885,360, filed on Oct. 1, 2013.

(30) Foreign Application Priority Data

Aug. 1, 2014 (TW) ..... 103126372 A

(51) Int. Cl.
*H01Q 1/27* (2006.01)
*H01Q 7/00* (2006.01)
*H01Q 5/364* (2015.01)

(52) U.S. Cl.
CPC ..... *H01Q 1/273* (2013.01); *H01Q 5/364* (2015.01); *H01Q 7/00* (2013.01)

(58) Field of Classification Search
CPC ..... H01Q 1/273; H01Q 7/00; H01Q 1/243; H01Q 1/44
USPC ..... 343/702, 718, 788
See application file for complete search history.

(56) References Cited

U.S. PATENT DOCUMENTS

2010/0238075 A1* 9/2010 Pourseyed ..... H01Q 21/28 343/702
2012/0231750 A1 9/2012 Jin et al.
2012/0242501 A1* 9/2012 Tran ..... A61B 5/0024 340/870.02
2012/0271121 A1* 10/2012 Della Torre ..... A61B 5/0059 600/301

(Continued)

FOREIGN PATENT DOCUMENTS

CN 1312617 9/2001
CN 101483270 7/2009

(Continued)

OTHER PUBLICATIONS

"Office Action of China Counterpart Application", issued on Sep. 29, 2016, p. 1-p. 7, in which the listed references were cited.

*Primary Examiner* — Dameon E Levi
*Assistant Examiner* — David Lotter
(74) *Attorney, Agent, or Firm* — Jianq Chyun IP Office

(57) ABSTRACT

A wearable electronic device includes a body and a wearing element. The body includes a conductive frame. The conductive frame includes a feeding point and at least one grounding point to form a first current path and a second current path. Furthermore, the conductive frame forms a loop antenna via the first current path and the second current path, respectively, so as to operate in a first band and a second band. The wearing element is connected to the body.

6 Claims, 3 Drawing Sheets

(56) References Cited

U.S. PATENT DOCUMENTS

| | | | | |
|---|---|---|---|---|
| 2013/0057437 | A1 | 3/2013 | Chiu et al. | |
| 2013/0215042 | A1* | 8/2013 | Messerschmidt | G06F 3/041 345/173 |
| 2014/0266920 | A1* | 9/2014 | Tran | H01Q 1/243 343/702 |
| 2015/0048979 | A1* | 2/2015 | Asrani | H01Q 5/0093 343/702 |

FOREIGN PATENT DOCUMENTS

| | | |
|---|---|---|
| CN | 102683861 | 9/2012 |
| CN | 102983405 | 3/2013 |
| CN | 103094690 | 5/2013 |
| JP | 2013183437 | 9/2013 |
| TW | 200504475 | 2/2005 |
| TW | 201214857 | 4/2012 |

* cited by examiner

WEARABLE ELECTRONIC DEVICE

CROSS-REFERENCE TO RELATED APPLICATION

This application claims the priority benefits of U.S. provisional application Ser. No. 61/885,360, filed on Oct. 1, 2013 and Taiwan application serial no. 103126372, filed on Aug. 1, 2014. The entirety of each of the above-mentioned patent applications is hereby incorporated by reference herein and made a part of specification.

BACKGROUND OF THE INVENTION

Field of the Invention

The invention relates to an electronic device and, more particularly, to a wearable electronic device.

Description of the Related Art

Conventionally, the size of a wearable electronic device (such as a smart watch) is compact for wearing easily. However, the space inside the wearable electronic device for installing an antenna is limited. Thus, the antenna element of the conventional wearable electronic device is usually disposed at other available positions (such as the watchband). However, the bending of the watchband is varied when it is worn by different users, and the bending of the watchband would affect the radio-frequency (RF) performance of the antenna element inside. Furthermore, the wearable electronic device cannot provide a stable wireless transmission function with the antenna in the said manner.

BRIEF SUMMARY OF THE INVENTION

A wearable electronic device which uses a conductive frame of a body to form a loop antenna is provided. Thus, the requirement of a compact wearable electronic device can be met, and the stableness of a wireless transmission function of the wearable electronic device can be improved.

A wearable electronic device includes a body and a wearing element. The body includes a conductive frame. The conductive frame includes a feeding point and at least a grounding point to form a first current path and a second current path. Furthermore, the conductive frame forms a loop antenna via the first current path and the second current path to operate in a first band and a second band, respectively. A wearing element is connected to the body.

The body further includes a conductive back cover, and the wearable electronic device further includes a physiological sensor. Moreover, the physiological sensor is electrically connected to the conductive frame and the conductive back cover, and the physiological sensor senses a physiological signal via the conductive frame and the conductive back cover.

These and other features, aspects and advantages of the present invention will become better understood with regard to the following description, appended claims, and accompanying drawings.

DETAILED DESCRIPTION OF THE EMBODIMENTS

Figure 1:
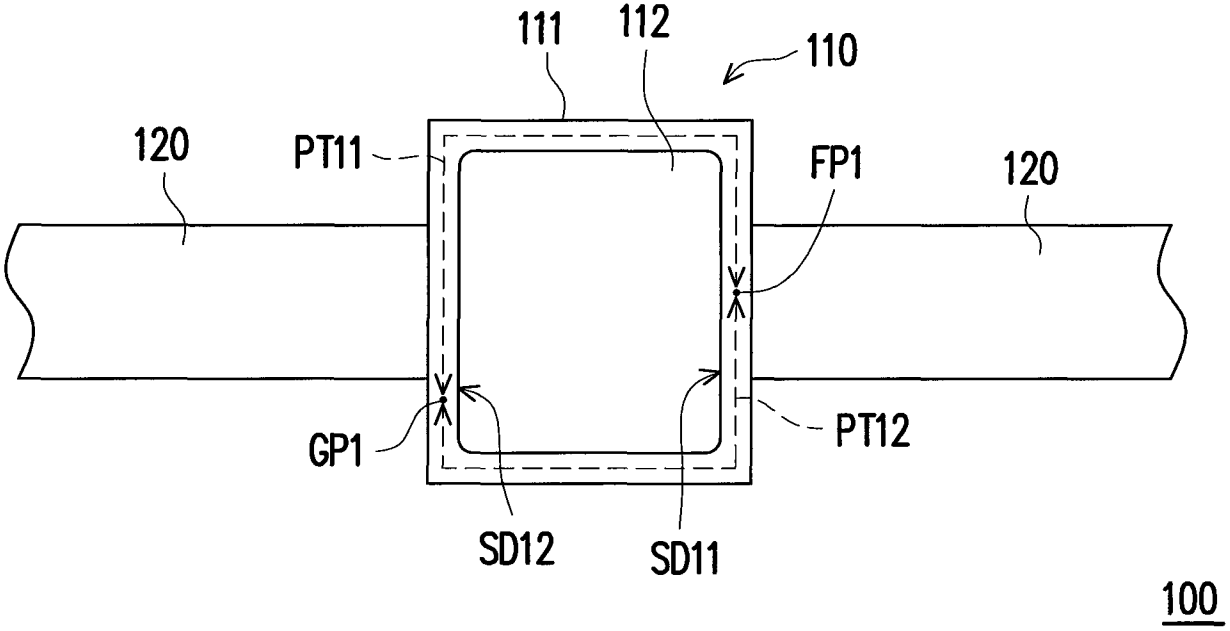
FIG. 1 is a plan schematic diagram showing a wearable electronic device in a first embodiment.

FIG. 1 is a plan schematic diagram showing a wearable electronic device in a first embodiment. As shown in FIG. 1, the wearable electronic device 100 includes a body 110 and a wearing element 120. The wearing element 120 is connected to two opposite edges of the body 110 respectively, and the wearing element 120 includes a band structure. The user can wear the wearable electronic device 100 on the wrist or the neck via the wearing element 120. The wearable electronic device 100 in FIG. 1 may be a smart watch, a wristband, earrings or a necklace.

The body 110 includes a conductive frame 111 and a display 112. The conductive frame 111 is disposed around the display 112. In other words, in the embodiment, the conductive frame 111 may be a metal frame of the display 112. Moreover, in another embodiment, the conductive frame 111 may also be a peripheral part of the casing of the body 110. The conductive frame 111 is not only an outer part of the wearable electronic device 100 but also can provide a function of an antenna element.

In detail, the conductive frame 111 includes a feeding point FP1 and a grounding point GP1. The feeding point FP1 can be formed at a first edge SD11 of the conductive frame 111, the grounding point GP1 can be formed at a second edge SD12 of the conductive frame 111, and the first edge SD11 is opposite to the second edge SD12. Thus, the conductive frame 111 extends from the feeding point FP1 to the grounding point GP1 in a predetermined direction (such as an anticlockwise direction) to form a first current path PT11. Moreover, the conductive frame 111 extends from the feeding point FP1 to the grounding point GP1 in a direction opposite to the predetermined direction (such as a clockwise direction) to form a second current path PT12. In other words, the conductive frame 111 can form two current paths PT11 and PT12 via the feeding point FP1 and the grounding point GP1.

The conductive frame 111 can form a loop antenna via the two current paths PT11 and PT12 to operate in a first band and a second band, respectively. For example, the conductive frame 111 may generate a resonant mode via the first current path PT11 to operate in the first band. Moreover, the conductive frame 111 can generate another resonant mode via the second current path PT12 to operate in the second band. The bandwidth of the first band may be 2400 MHz to 2484 MHz, and the bandwidth of the second band may be 5100 MHz to 5875 MHz. In other words, the wearable electronic device 100 can operate at the frequency band of Bluetooth and 2.4G or 5G wireless fidelity (WiFi) via the conductive frame 111. Additionally, the length of the first current path PT11 equals to the wavelength of a center resonant frequency of the first band, and the length of the second current path PT12 equals to the wavelength of the center resonant frequency of the second band. In other words, the double-loop antenna formed by the conductive frame 111 may be a one-wavelength loop antenna, and it may have the features of a balanced structure antenna. The induced current at the system ground plane is alleviated, and thus the resonant frequency of the antenna would not be affected by the size of the system ground plane.

The conductive frame 111 of the body 110 of the wearable electronic device 100 is used to form an antenna element (which is a double-loop antenna), the physical space for the antenna element is thus reduced, and the wearable electronic device 100 can be smaller. The antenna element has high integrity with the body 110, and the appearance of the conductive frame 111 is also kept, that is, the conductive frame 111 maintains a complete close loop. Furthermore, the antenna element formed by the conductive frame 111 would not be affected by the bending of the wearing element 120, which can help improve the wireless transmission function of the wearable electronic device 100.

Figure 2:
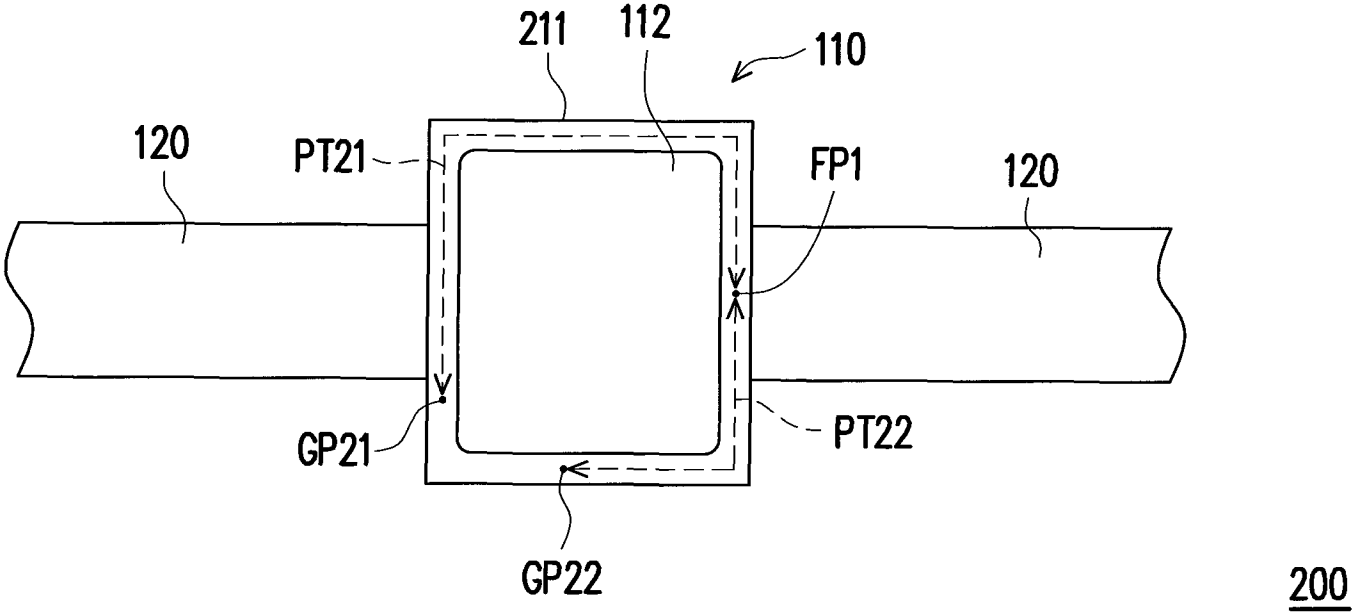
FIG. 2 is a plan schematic diagram showing a wearable electronic device in a second embodiment.

The feeding point FP1 and one single grounding point GP1 of the conductive frame 111 in FIG. 1 are used to form the two current paths PT11 and PT12. However, in another embodiment, the conductive frame 111 may also include the feeding point FP1 and two grounding points to form two current paths. For example, FIG. 2 is a plan schematic diagram showing a wearable electronic device in a second embodiment. The main difference between the embodiments in FIG. 2 and FIG. 1 is that the conductive frame 211 of the wearable electronic device 200 in FIG. 2 includes a first grounding point GP21 and a second grounding point GP22.

In detail, the conductive frame 211 extends from the feeding point FP1 to the first grounding point GP21 in a predetermined direction (such as the anticlockwise direction) to form a first current path PT21. Moreover, the conductive frame 211 extends from the feeding point FP1 to the second grounding point GP22 in a direction opposite to the predetermined direction (such as the clockwise direction) to form a second current path PT22. In other words, the conductive frame 211 can generate two current paths PT21 and PT22 via the feeding point FP1 and the two grounding points GP21 and GP22. The two grounding points GP21 and GP22 can be formed at appropriate positions separately to adjust the length of the current paths PT21 and PT22, and thus the two resonant modes of the antenna element can be controlled, respectively.

Similar with the embodiment in FIG. 1, the conductive frame 211 can generate two resonant modes via the two current paths PT21 and PT22 to operate in the first band and the second band. In other words, the conductive frame 211 is not only an outer part but also can provide a function of an antenna element. Thus, the wearable electronic device 200 can be smaller, the wholeness of the conductive frame 211 and a better wireless transmission function are also kept. Other components of the embodiment in FIG. 2 are already illustrated in the previous embodiment, which is omitted herein.

Figure 3:
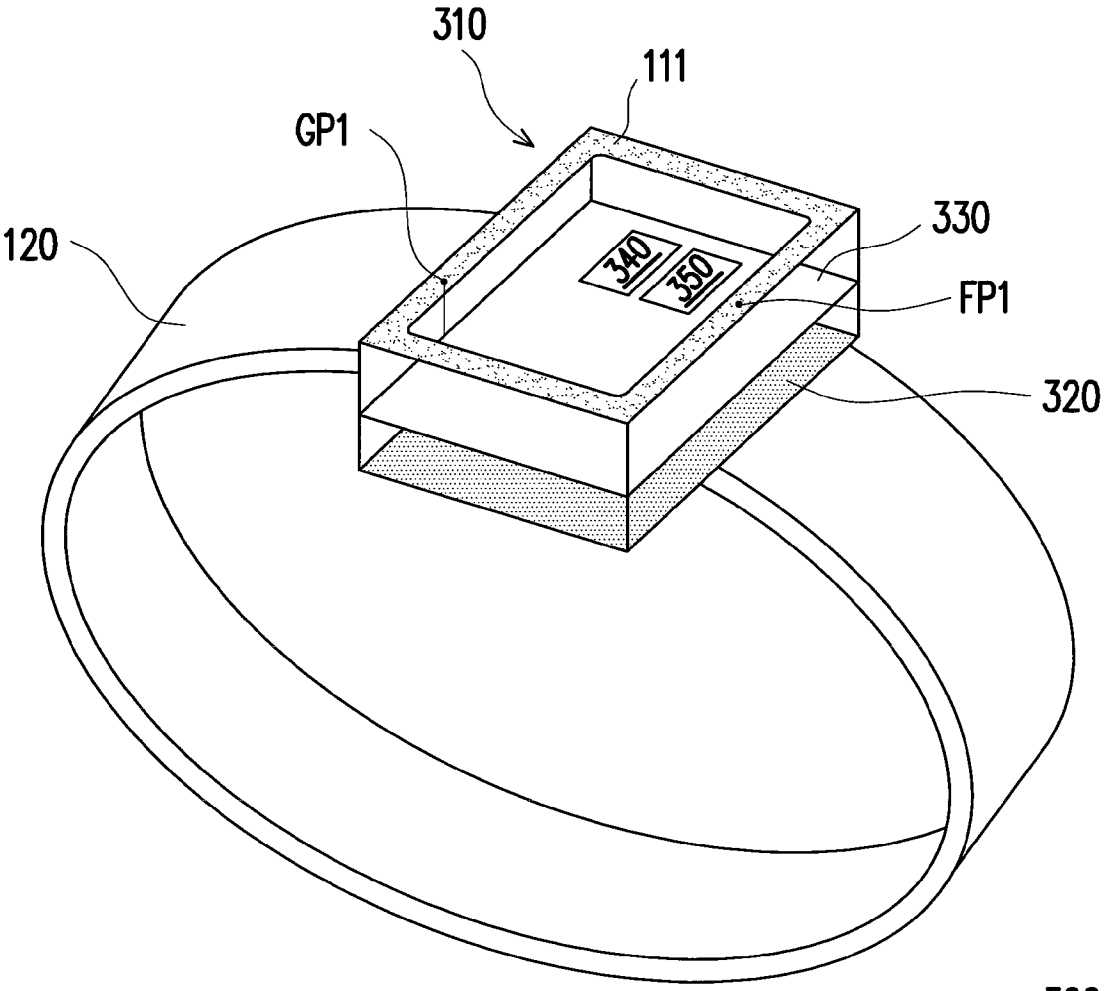
FIG. 3 is a schematic diagram showing a wearable electronic device in a third embodiment.

Regardless of whether the conductive frame includes a single grounding point or two grounding points, the wearable electronic device can form sensing electrodes of a physiological sensor via the conductive frame. For example, FIG. 3 is a schematic diagram showing a wearable electronic device in a third embodiment. The main difference between the embodiment in FIG. 3 and that in FIG. 1 is that the body 310 of the wearable electronic device 300 in FIG. 3 further includes a conductive back cover 320, and the wearable electronic device 300 further includes a system ground plane 330, a physiological sensor 340 and a transceiver 350. The physiological sensor 340 is connected to the conductive frame 111 and the conductive back cover 320, and the conductive frame 111 and the conductive back cover 320 are taken as two electrodes for receiving a physiological signal.

In detail, the body 310 includes an accommodating space, and the system ground plane 330, the physiological sensor 340 and the transceiver 350 are disposed in the accommodating space of the body 310. The feeding point FP1 of the conductive frame 111 is electrically connected to the transceiver 350, and the grounding point GP1 of the conductive frame 111 is electrically connected to the system ground plane 330. Thus, the transceiver 350 can receive or send an electromagnetic wave via the conductive frame 111.

On the other hand, the system ground plane 330 is direct current blocked (DC block) against the conductive back cover 320, and the system ground plane 330 is also DC blocked against the conductive frame 111. They are connected via a diode or a high-frequency capacitor connected therebetween, respectively, so as to achieve an effect of DC block and alternating current feed (AC feed).

The physiological sensor 340 is electrically connected to the conductive frame 111 and the conductive back cover 320. As for the physiological sensor 340, the conductive frame 111 is regarded as a positive electrode, and the conductive back cover 320 is regarded as a negative electrode. Consequently, the physiological sensor 340 can sense a physiological signal via the conductive frame 111 and the conductive back cover 320. For example, when the user wears the wearable electronic device 300 on one wrist, the conductive back cover 320 of the body 310 is attached to the user skin. If the user touches the conductive frame 111 by the other hand, the physiological sensor 340 can sense the physiological signal, such as an electrocardiogram (ECG) signal, via the conductive frame 111 and the conductive back cover 320. Thus, the physiological sensor 340 can monitor a physiological state, such as heartbeat, via the sensed physiological signal.

In detail, when an operating band of the ECG signal is measured, the system ground plane 330 is DC blocked against the conductive back cover 320, but in the operating band of the antenna element, the system ground plane 330 and the conductive back cover 320 are AC conducted. Similarly, when an operating band of the ECG signal is measured, the system ground plane 330 is DC blocked against the conductive frame 111, but in the operating band of the antenna element, the system ground plane 330 and the conductive frame 111 are AC conducted.

In sum, the loop antenna is formed at the conductive frame of the wearable electronic device, and the loop antenna operates in the first band and the second band. In other words, the conductive frame is not only an outer part of the wearable electronic device but also can provide a function of an antenna element. Thus, the wearable electronic device can be smaller and the wholeness of the conductive frame is kept. Furthermore, the antenna element formed by the conductive frame would not be affected by the bending of the wearing element, which can help improve the wireless transmission function of the wearable electronic device.

Although the present invention has been described in considerable detail with reference to certain preferred embodiments thereof, the disclosure is not for limiting the scope. Persons having ordinary skill in the art may make various modifications and changes without departing from the scope. Therefore, the scope of the appended claims should not be limited to the description of the preferred embodiments described above.

What is claimed is:

1. A wearable electronic device, comprising:

a body including a conductive frame and a conductive back cover, the conductive frame includes a feeding point and at least a grounding point to form a first current path and a second current path thereon, the conductive frame forms a loop antenna which generates two resonant modes via the first current path and the second current path to operate in a first band and a second band;

a wearing element connected to the body;

a physiological sensor electrically connected to the conductive frame and the conductive back cover; and a system ground plane, wherein when the physiological sensor senses the physiological signal via the conductive frame and the conductive back cover, the system ground plane is DC blocked against the conductive frame and the conductive back cover, wherein when the conductive frame is operated in the first band and the second band, the system ground plane is AC conducted with the conductive frame and the conductive back cover.

2. The wearable electronic device according to claim 1, wherein when the number of the grounding point is one, the first current path extends from the feeding point to the grounding point in a predetermined direction, and the second current path extends from the feeding point to the grounding point in a direction opposite to the predetermined direction.

3. The wearable electronic device according to claim 1, wherein the conductive frame includes a first grounding point and a second grounding point, the first current path extends from the feeding point to the first grounding point in a predetermined direction, and the second current path extends from the feeding point to the second grounding point in a direction opposite to the predetermined direction.

4. The wearable electronic device according to claim 1, wherein a length of the first current path equals to one wavelength at a center resonant frequency of the first band.

5. The wearable electronic device according to claim 1, wherein a length of the second current path equals to one wavelength at a center resonant frequency of the second band.

6. The wearable electronic device according to claim 1, wherein the body further includes a display, and the conductive frame is disposed around the display.

* * * * *